US009097217B2

(12) United States Patent
Villaire et al.

(10) Patent No.: US 9,097,217 B2
(45) Date of Patent: Aug. 4, 2015

(54) PROPULSION SYSTEMS AND MODULES FOR VEHICLES

(75) Inventors: William L. Villaire, Clarkston, MI (US); Ryan A. Buccafurri, Royal Oak, MI (US); Peter N. C. Nguyen, Sterling Heights, MI (US); Gordon G. Rinke, Sterling Heights, MI (US)

(73) Assignee: GM GLOBAL TECHNOLOGY OPERATIONS. LLC, Detroit, MI (US)

( * ) Notice: Subject to any disclaimer, the term of this patent is extended or adjusted under 35 U.S.C. 154(b) by 456 days.

(21) Appl. No.: 13/223,028

(22) Filed: Aug. 31, 2011

(65) Prior Publication Data

US 2013/0047965 A1 Feb. 28, 2013

(51) Int. Cl.

| | |
|---|---|
| ***F02M 37/04*** | (2006.01) |
| ***F02M 37/00*** | (2006.01) |
| ***F02M 37/10*** | (2006.01) |

(52) U.S. Cl.

CPC ..... *F02M 37/0029* (2013.01); *F02M 37/0052* (2013.01); *F02M 37/103* (2013.01)

(58) Field of Classification Search

USPC ..... 123/495, 497, 498, 502, 506, 507, 510; 417/307, 423.3, 423.9; 137/115.14, 137/115.15, 115.18, 14, 171, 409, 565.13, 137/539, 539.5, 540

See application file for complete search history.

(56) References Cited

U.S. PATENT DOCUMENTS

| | | | | |
|---|---|---|---|---|
| 5,058,557 | A * | 10/1991 | Frank et al. | 123/509 |
| 5,630,399 | A * | 5/1997 | Nomura et al. | 123/467 |
| 6,067,963 | A * | 5/2000 | Oi et al. | 123/458 |
| 6,189,432 | B1 * | 2/2001 | Colarelli et al. | 91/171 |
| 6,715,471 | B2 * | 4/2004 | Hiraiwa et al. | 123/497 |
| 6,899,113 | B2 * | 5/2005 | Parrish et al. | 137/1 |
| 7,275,524 | B2 * | 10/2007 | Schelhas et al. | 123/514 |
| 7,278,404 | B2 * | 10/2007 | Wolters et al. | 123/514 |
| 7,441,545 | B1 * | 10/2008 | Fisher et al. | 123/467 |
| 7,832,379 | B2 * | 11/2010 | Schelhas et al. | 123/510 |
| 8,333,175 | B2 * | 12/2012 | Nishio et al. | 123/458 |
| 2001/0018908 | A1 * | 9/2001 | Joos et al. | 123/497 |
| 2002/0124834 | A1 * | 9/2002 | Rembold et al. | 123/514 |
| 2004/0258537 | A1 * | 12/2004 | Kim | 417/307 |
| 2005/0061372 | A1 * | 3/2005 | McGrath et al. | 137/539.5 |
| 2008/0025849 | A1 * | 1/2008 | Okamoto et al. | 417/213 |
| 2010/0242921 | A1 * | 9/2010 | Harper | 123/506 |
| 2011/0220829 | A1 * | 9/2011 | Haemel et al. | 251/366 |
| 2011/0277850 | A1 * | 11/2011 | Greene et al. | 137/14 |
| 2011/0297259 | A1 * | 12/2011 | Sundquist | 137/565.13 |
| 2011/0301881 | A1 * | 12/2011 | Danzy | 702/50 |
| 2012/0024400 | A1 * | 2/2012 | Smit | 137/409 |

* cited by examiner

*Primary Examiner* — John Kwon
*Assistant Examiner* — Johnny H Hoang
(74) *Attorney, Agent, or Firm* — Ingrassia Fisher & Lorenz, P.C.

(57) ABSTRACT

Propulsion systems for vehicles are provided. The propulsion system includes an engine and a module. The module includes a fuel pump, a check valve, and a relief valve. The fuel pump is configured to supply fuel flow having a pressure. The check valve is configured to receive the fuel flow from the fuel pump, and to allow passage of the fuel flow to the engine. The relief valve is coupled to the fuel pump and configured to release a portion of the pressure of the fuel flow. The relief valve is disposed upstream of the check valve.

20 Claims, 4 Drawing Sheets

PROPULSION SYSTEMS AND MODULES FOR VEHICLES

TECHNICAL FIELD

The present disclosure generally relates to the field of vehicles and, more specifically, to propulsion systems and modules for vehicles.

BACKGROUND

Various automobiles and other vehicles include propulsion systems that include an engine and a fuel pump for delivering fuel to the engine. For example, diesel-powered vehicles generally have a propulsion system that includes a diesel fuel combustion engine and a fuel pump module for delivering pressurized diesel fuel to the combustion engine. The fuel pump modules typically have a pressure release device or system to help alleviate pressure build up, for example when the fuel pump is running but the engine is not running. However, existing pressure release devices or systems for vehicle fuel pump modules may not optimally handle large fuel flows in certain situations, such as when the fuel pump is running and the engine is not running.

Accordingly, it is desirable to provide modules that provide for improved pressure relief for a vehicle propulsion system, for example that may better handle large fuel flows in certain situations, such as when the fuel pump is running and the engine is not running. It is also desirable to provide improved vehicle propulsion systems that include such improved modules. It is further desirable to provide improved vehicles that include such fuel pump modules and propulsion systems. Furthermore, other desirable features and characteristics of the present invention will be apparent from the subsequent detailed description and the appended claims, taken in conjunction with the accompanying drawings and the foregoing technical field and background.

SUMMARY

In accordance with an exemplary embodiment, a module is provided for a propulsion system of a vehicle, the propulsion system having an engine. The module comprises a fuel pump, a check valve, and a relief valve. The fuel pump is configured to supply fuel flow having a pressure. The check valve is configured to receive the fuel flow from the fuel pump, and to allow passage of the fuel flow to the engine. The relief valve is coupled to the fuel pump, and is configured to release a portion of the pressure of the fuel flow. The relief valve is disposed upstream of the check valve.

In accordance with another exemplary embodiment, a propulsion system is provided for a vehicle. The propulsion system comprises an engine, a fuel pump, a check valve, and a relief valve. The fuel pump is configured to supply fuel flow having a pressure. The check valve is configured to receive the fuel flow from the fuel pump and to allow passage of the fuel flow to the engine. The relief valve is coupled to the fuel pump, and is configured to release a portion of the pressure of the fuel flow. The relief valve is disposed upstream of the check valve.

In accordance with a further exemplary embodiment, a vehicle is provided. The vehicle comprises a drive system and a propulsion system. The propulsion system is coupled to the drive system, and comprises an engine, a fuel pump, a check valve, and a relief valve. The fuel pump is configured to supply fuel flow having a pressure. The check valve is configured to receive the fuel flow from the fuel pump and to allow passage of the fuel flow to the engine. The relief valve is coupled to the fuel pump, and is configured to release a portion of the pressure of the fuel flow. The relief valve is disposed upstream of the check valve.

BRIEF DESCRIPTION OF THE DRAWINGS

The present disclosure will hereinafter be described in conjunction with the following drawing figures, wherein like numerals denote like elements, and wherein.

DETAILED DESCRIPTION

The following detailed description is merely exemplary in nature and is not intended to limit the disclosure or the application and uses thereof. Furthermore, there is no intention to be bound by any theory presented in the preceding background or the following detailed description.

Figure 1:
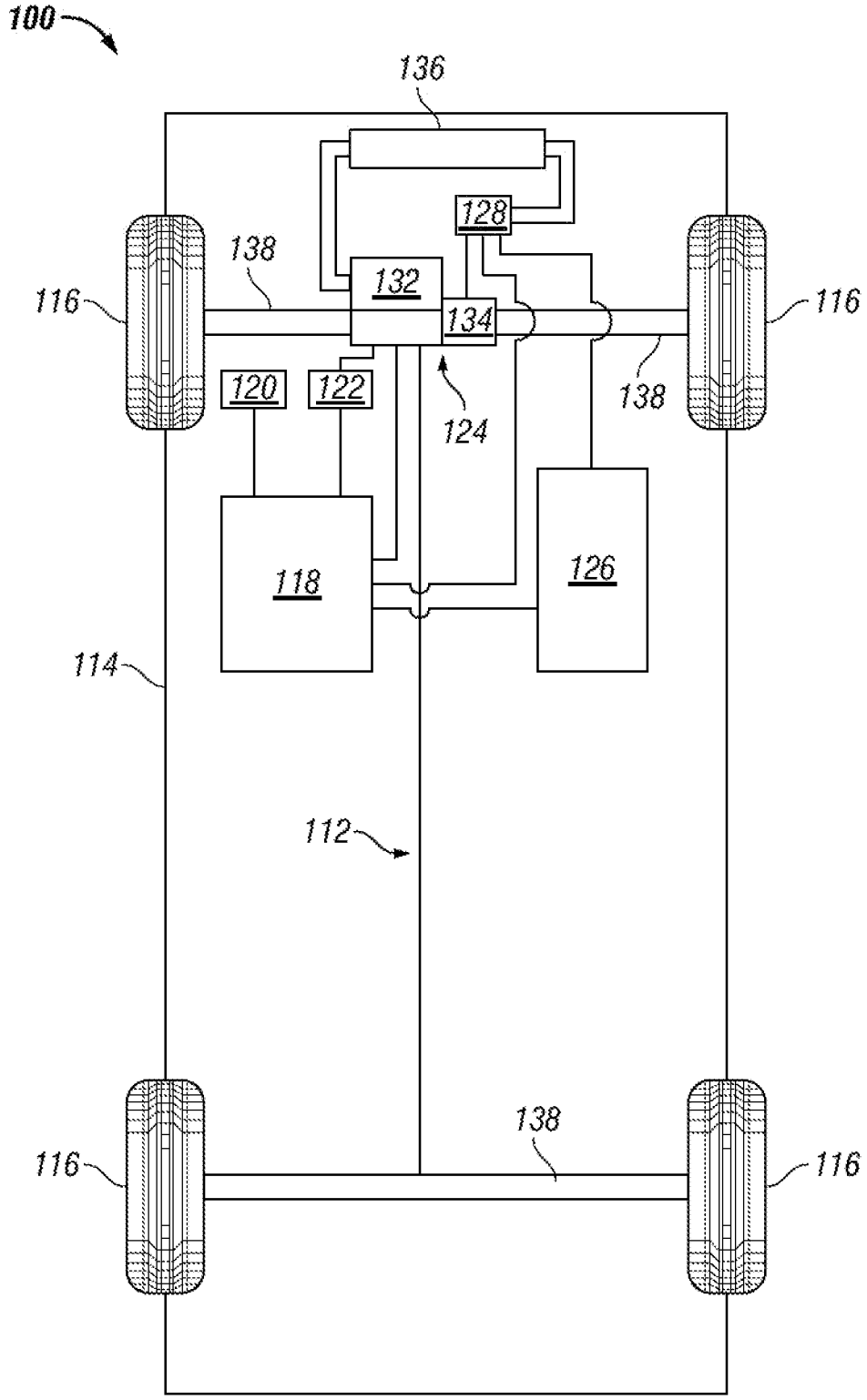
FIG. 1 is a functional block diagram of a vehicle that includes a propulsion system that includes an engine, such as a diesel-fuel combustion engine, and a fuel pump module that includes a pressure relief component, in accordance with an exemplary embodiment.

FIG. 1 illustrates a vehicle 100, or automobile, according to an exemplary embodiment. As described in greater detail further below, the vehicle 100 includes a propulsion system 124 having a fuel pump module 134 that provides fuel to an engine 132 of the vehicle 100, and that includes a relief valve positioned upstream of a check valve of the fuel pump module 134 for improved pressure relief for the propulsion system 124.

As depicted in FIG. 1, the vehicle 100 includes a chassis 112, a body 114, four wheels 116, an electronic control system 118, a steering system 120, a braking system 122, and a propulsion system 124. The body 114 is arranged on the chassis 112 and substantially encloses the other components of the vehicle 100. The body 114 and the chassis 112 may jointly form a frame. The wheels 116 are each rotationally coupled to the chassis 112 near a respective corner of the body 114. The vehicle 100 may be any one of a number of different types of automobiles, such as, for example, a sedan, a wagon, a truck, or a sport utility vehicle (SUV), and may be two-wheel drive (2WD) (i.e., rear-wheel drive or front-wheel drive), four-wheel drive (4WD) or all-wheel drive (AWD).

In certain embodiments (for example, in which the vehicle 100 is a hybrid electric vehicle), the vehicle 100 also includes an energy storage system (ESS) 126 that is mounted on the chassis 112 and is electrically connected to an inverter 128. The ESS 126 preferably comprises a battery having a pack of battery cells. In one embodiment, the ESS 126 comprises a lithium iron phosphate battery, such as a nanophosphate lithium ion battery. Together the ESS 126 and propulsion system(s) 124 provide a drive system to propel the vehicle 100.

The steering system 120 is mounted on the chassis 112, and controls steering of the wheels 116. The steering system 120 includes a steering wheel and a steering column (not depicted). The steering wheel receives inputs from a driver of the vehicle. The steering column results in desired steering angles for the wheels 116 via drive shafts 138 based on the inputs from the driver.

The braking system 122 provides braking for the vehicle 100. The braking system 122 includes a brake pedal (not depicted) for receiving inputs from a driver, and also includes brake units (not depicted) for providing braking torque and friction to stop or slow the vehicle. In addition, driver inputs are also obtained via an accelerator pedal (not depicted) of the vehicle.

The propulsion system 124 is mounted on the chassis 112, and drives the wheels 116. The propulsion system 124 includes the above-referenced engine 132 and fuel pump module 134. In a preferred embodiment, the engine 132 comprises a diesel-fueled combustion engine. The vehicle 100 may also incorporate any one of, or combination of, a number of different types of electrical propulsion systems and/or engines, such as, for example, a gasoline fueled combustion engine, a "flex fuel vehicle" (FFV) engine (i.e., using a mixture of gasoline and ethanol), a gaseous compound (e.g., hydrogen or natural gas) fueled engine, a combustion/engine hybrid engine, and an engine. In certain embodiments, the vehicle 100 also includes a radiator 136 that is connected to the frame at an outer portion thereof and although not illustrated in detail, includes multiple cooling channels therein that contain a cooling fluid (i.e., coolant) such as water and/or ethylene glycol (i.e., "antifreeze") and is coupled to the engine 132.

As will be appreciated by one skilled in the art, the engine 132 includes a transmission therein, and, although not illustrated, also includes a stator assembly (including conductive coils), a rotor assembly (including a ferromagnetic core), and a cooling fluid or coolant. The stator assembly and/or the rotor assembly within the engine 132 may include multiple electromagnetic poles, as is commonly understood. The engine 132 is integrated such that it is mechanically coupled to at least some of the wheels 116 through one or more of the drive shafts 138.

The fuel pump module 134 provides fuel for the engine 132. As described in greater detail below, the fuel pump module 134 includes a pressure relief system for potentially improved fuel flow and/or release of pressure build-up for fuel flow to the engine 132.

Figure 2:
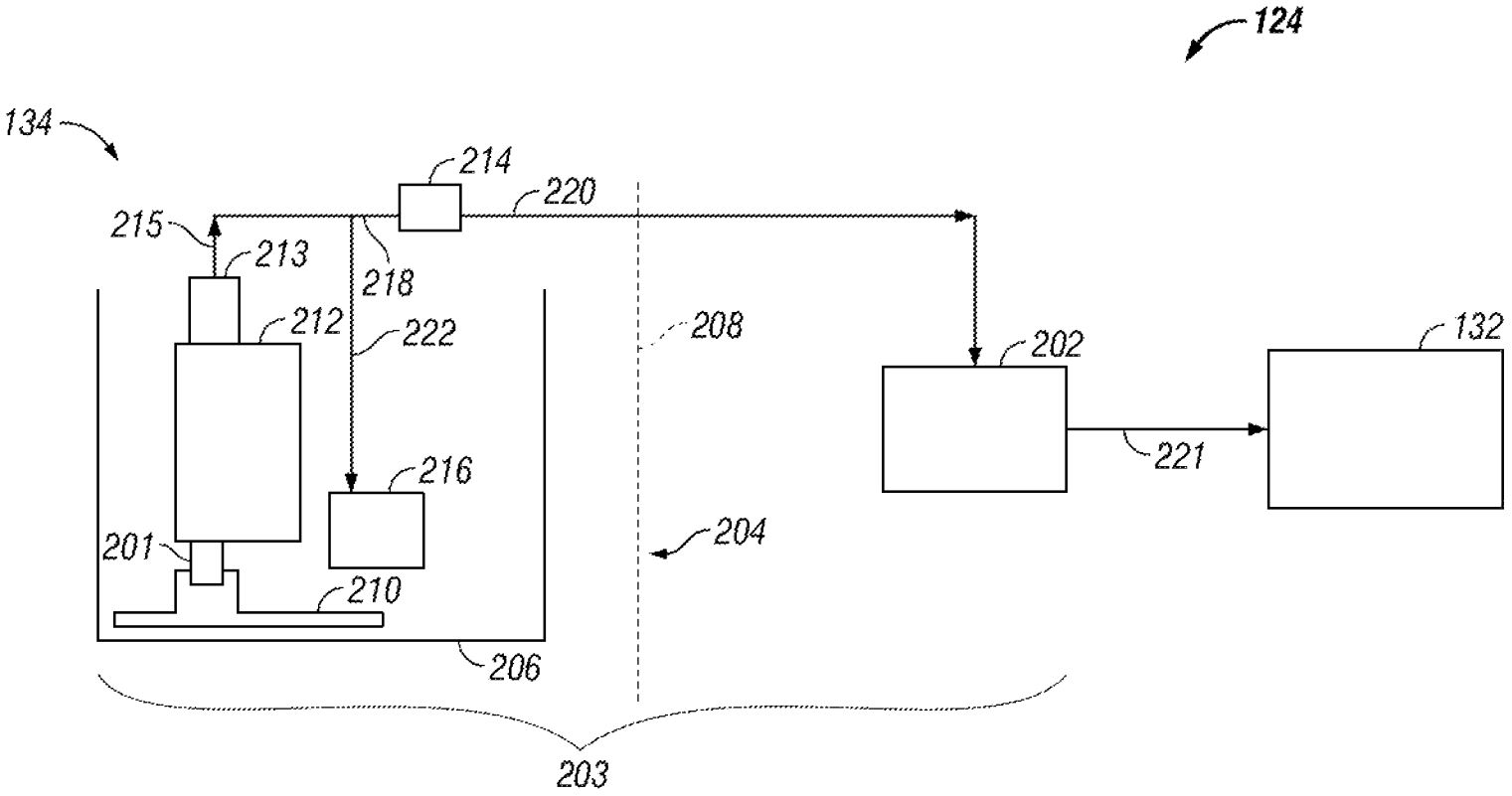
FIG. 2 is a functional block diagram of a vehicle propulsion system that can be implemented in connection with the vehicle of FIG. 1, and that includes an engine and a fuel pump module, in accordance with an exemplary embodiment.

With reference to FIG. 2, a functional block diagram depicts the propulsion system 124 in greater detail, in accordance with an exemplary embodiment. As depicted in FIG. 2, the propulsion system includes the fuel pump module 134 and the engine 132 of FIG. 1, along with a fuel filter 202 coupled therebetween. Also as depicted in FIG. 2, the fuel pump module 134 and the fuel filter 202 may also be collectively referred to as a module 203 coupled to the engine 132.

The fuel pump module 134 is disposed within a fuel tank 204 of the vehicle. Specifically, the fuel pump module 134 is disposed within a reservoir 206 inside the fuel tank 204. The reservoir 206 is disposed in an interior region of the fuel tank 204, and is surrounded by a wall 208 of the fuel tank 204.

The fuel pump module 134 includes a strainer 210, a fuel pump 212, a check valve 214, and a pressure relief valve 216. The strainer 210 strains or filters the fuel entering the fuel pump 212 through an inlet 201 of the fuel pump 212. The fuel pump 212 pumps and compresses the fuel, and provides a pressurized fuel flow for ultimate use by the engine 132. Specifically, the fuel pump 212 provides the pressurized fuel flow via a first line or path 218. In a preferred embodiment, the fuel pump 212 is a positive displacement, low pressure fuel pump.

The check valve 214 receives pressurized fuel flow from the fuel from the fuel pump 212 (specifically, from an outlet 213 of the fuel pump 212) via the first line or path 215. The check valve 214 allows passage of the pressurized fuel along a second line or path 220 toward the engine 132. Specifically, the pressurized fuel flows from the check valve 214 to the fuel filter 202 via the second line or path 220. The pressurized fuel is filtered by the fuel filter 202, and then flows from the fuel filter 202 to the engine 132 via a third line or path 221 and is then used by the engine 132 for operation of the vehicle.

The relief valve 216 is disposed upstream of the check valve 214. The relief valve 216 is disposed within the fuel tank 204 along with the other components of the fuel pump module 134. The relief valve 216 is disposed between the outlet 213 of the fuel pump 212 and the check valve 214. Unlike certain existing systems, the relief valve 216 is not part of the fuel pump 212 itself, and is not directly physically attached to the fuel pump 212.

The relief valve 216 receives a portion of the pressurized fuel flow from the fuel pump 212 via a fourth line or path 222. During normal operation of the propulsion system 124, pressure release may be provided via pistons of the engine 132. However, under certain conditions (such as under relatively cold temperature conditions, at relatively large flow rates, and/or when the fuel pump 212 is operating but the engine 132 is not running), pressure relief is provided by the relief valve 216. This is particularly applicable for diesel fuel engines, as diesel fuel can cloud up or solidify without such pressure relief as temperatures decrease without such pressure relief.

Figure 3:
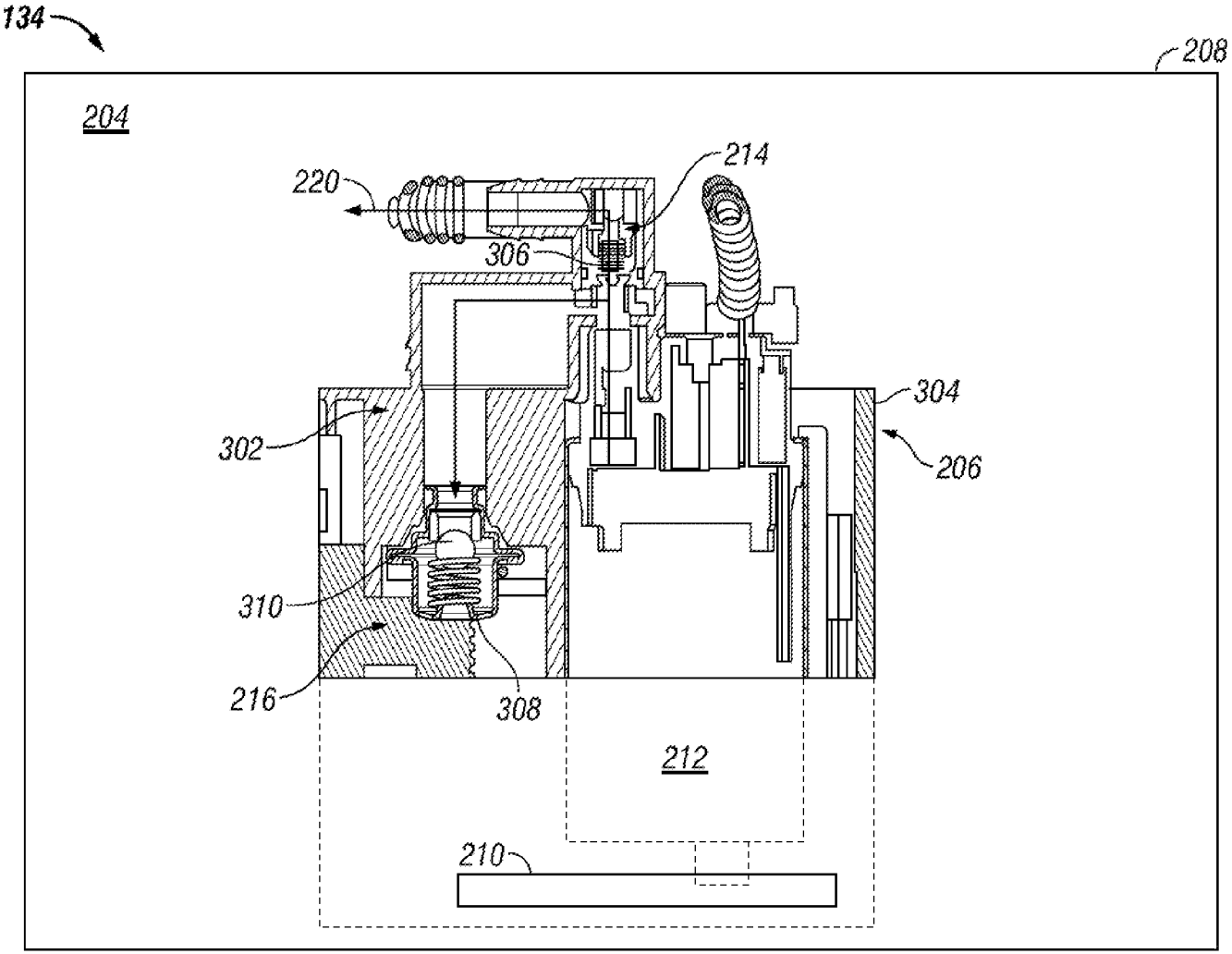
FIG. 3 is a cross sectional view of the fuel pump module 134 of FIG. 2, in accordance with an exemplary embodiment.
Figure 4:
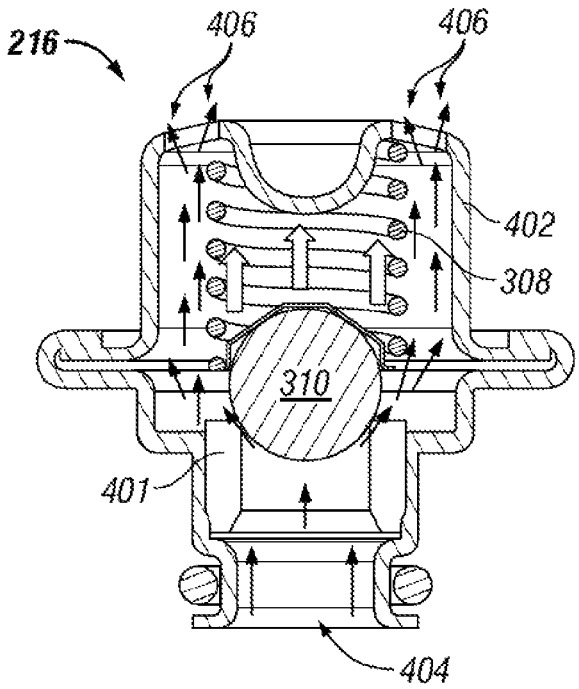
FIG. 4 is an inverted, cross sectional view of the relief valve 216 of FIG. 2, in accordance with an exemplary embodiment.
Figure 5:
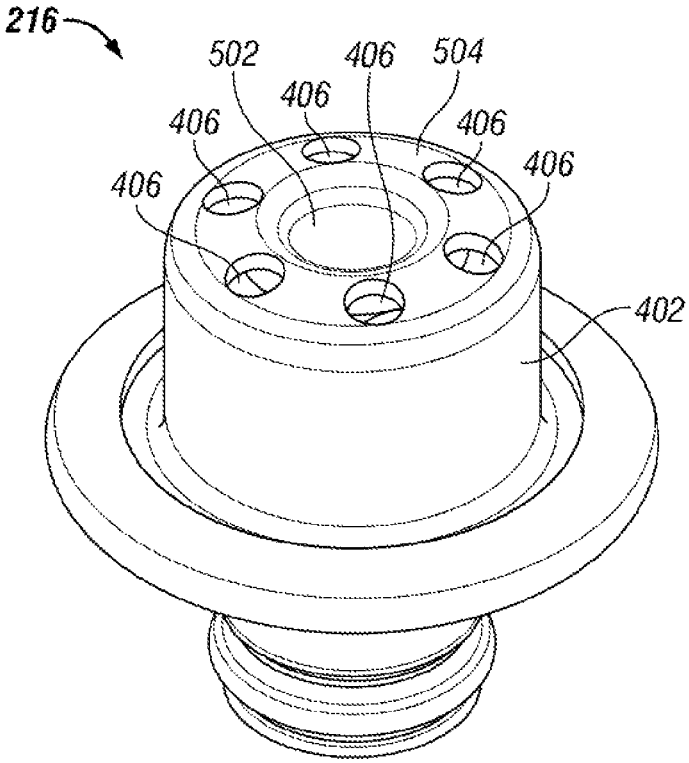
FIG. 5 is an inverted plan view of the relief valve 216 of FIG. 2, in accordance with an exemplary embodiment.

The fuel pump module 134, including the relief valve 216 thereof, is depicted further in FIGS. 3-5. Specifically, FIG. 3 is a cross sectional view of the fuel pump module 134 of FIG. 2. FIG. 4 is an inverted, cross sectional view of the relief valve 216 of FIG. 2. FIG. 5 is an inverted plan view of the relief valve 216 of FIG. 2.

As shown in FIG. 3, the strainer 210, the fuel pump 212, the check valve 214, and the relief valve 216 are coupled together along a retainer 302 with the fuel tank 204. The retainer 302 preferably comprises a housing within which the strainer 210, the fuel pump 212, the check valve 214, and the relief valve 216 are disposed. Preferably, the strainer 210, the fuel pump 212, the check valve 214, and the relief valve 216 are mounted on and held together by the retainer 302. In a preferred embodiment, the retainer 302 is made of molded plastic, and preferably snaps into place within the reservoir 206. The retainer 302 is surrounded by a wall 304 of the reservoir 206. The wall 304 is surrounded by the fuel tank wall 208, and is disposed within the fuel tank 204.

Also as shown in FIG. 3, the check valve 214 is spring-loaded with a spring 306. When a fluid pressure of the fuel flowing from the fuel pump 212 toward the check valve 214 overcomes a spring force of the spring 306, pressurized fuel flows through the check valve 214 toward the fuel filter 202 of FIG. 2, and ultimately to the engine 132 of FIGS. 1 and 2.

With further reference to FIG. 3 as well as FIGS. 4 and 5, the relief valve 216 is also spring-loaded with a spring 308. The relief valve 216 further includes a valve element 310, a seat 401, a valve body 402, an inlet 404, and outlets 406. The valve element 310, spring 308, and seat 401 are each disposed within the valve body 402, and the inlet 404 and outlets 406 are formed within the valve body 402.

The valve element 310 rests against the seat 401 when the relief valve 216 is in the closed position. As fluid pressure from the fuel entering the relief valve 216 via the inlet 404 exceeds the spring force of the spring 308, the valve element 310 is moved upward off the seat 401, and fuel flows around the valve element 310 and toward the outlets 406. The fuel then flows out of the relief valve 216 via the outlets 406 and back into the reservoir 206. Conversely, when the fluid pressure from the fuel entering the relief valve 216 via the inlet 404 is less than the spring force of the spring 308, the valve element 310 is seated against the seat 401, the seat 401 seals the relief valve 216, and the fuel is inhibited (and preferably prevented) from flowing around the valve element 310 and toward the outlets 406.

In the depicted embodiment, the valve element 310 comprises a spherical, ball-type element. Also in the depicted embodiment, the relief valve 216 includes six circular outlets 402 disposed circumferentially around a center 502 of a lower surface 504 of the housing 402. In one embodiment, the relief valve 216 opens (and the valve element 310 thereof moves off of the seat 401, to allow fuel flow through the relief valve 216) when the fluid pressure of the fuel flow exceeds five hundred Kilopascals (500 Kpa).

The propulsion system 124, including the fuel pump module 134 thereof, provides for potentially improved pressure release for the propulsion system 124. By having the relief valve 216 disposed upstream of the check valve 214, and between the outlet 213 of the fuel pump 212 and the check valve 214 within the fuel tank 208, a more precise pressure regulation may be attained (as compared with existing systems). The pressure relief provided by the relief valve 216 helps to protect the fuel filter 202 from excess pressure. In addition, these features allow for the relief valve 216 to act similar to a variable orifice when the fuel pump 212 is operating. As such, the fuel pump 212 need not be leak-free when the vehicle is powered (specifically, when the engine 132 is not operating), and therefore does not affect vehicle start times, as may occur with existing systems under certain conditions.

Accordingly, vehicles are provided having improved fuel pump modules. Such fuel pump modules are also provided, along with relief valve systems that are used as part of the fuel pump modules. The disclosed vehicles, fuel pump modules, and relief valve systems include a relief valve positioned upstream of the check valve for improved pressure relief for the fuel pump module.

It will be appreciated that the disclosed vehicles, systems, and devices may vary from those depicted in the Figures and described herein. For example, the vehicle 100, the engine 132, the fuel pump module 134 and/or various components thereof may vary from that depicted in FIGS. 1 and 2 and described in connection therewith.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

We claim:

1. A module for a propulsion system of a vehicle having a fuel tank, the propulsion system having an engine, the module comprising:

a retainer housing disposed within the fuel tank;

a fuel pump mounted on the retainer housing and configured to supply fuel flow having a pressure;

a check valve mounted on the retainer housing and configured to receive the fuel flow from the fuel pump and to allow passage of the fuel flow toward the engine; and a relief valve mounted on the retainer housing, coupled to the fuel pump, and configured to release a portion of the pressure of the fuel flow, the relief valve disposed upstream of the check valve.

2. The module of claim 1, further comprising:

a fuel filter coupled to the check valve and configured to filter the fuel flow between the check valve and the engine.

3. The module of claim 1, wherein the relief valve is connected between the fuel pump and the check valve and is not part of the fuel pump.

4. The module of claim 1, further comprising:

a strainer mounted on the retainer housing and coupled to the fuel pump.

5. The module of claim 1, wherein the retainer housing comprises a molded plastic.

6. The module of claim 1, wherein the relief valve comprises:

a valve body;

an inlet formed within the valve body;

a plurality of outlets formed circumferentially around a center of the valve body; and a spring-loaded valve element disposed within the valve body and configured to control fluid flow from the inlet to the plurality of outlets.

7. A propulsion system for a vehicle having a diesel fuel tank, the propulsion system comprising:

a retainer housing disposed within the diesel fuel tank;

a diesel fuel combustion engine;

a fuel pump mounted on the retainer housing and configured to supply fuel flow having a pressure;

a check valve mounted on the retainer housing and configured to receive the fuel flow from the fuel pump and to allow passage of the fuel flow to the diesel fuel combustion engine; and a relief valve mounted on the retainer housing, coupled to the fuel pump, and configured to release a portion of the pressure of the fuel flow, the relief valve disposed upstream of the check valve.

8. The propulsion system of claim 7, further comprising:

a fuel filter coupled between the check valve and the engine and configured to filter the fuel flow between the check valve and the diesel fuel combustion engine.

9. The propulsion system of claim 7, wherein the relief valve is connected between the fuel pump and the check valve and is not part of the fuel pump.

10. The propulsion system of claim 7, further comprising:

a strainer mounted on the retainer housing and coupled to the fuel pump.

11. The propulsion system of claim 7, wherein the retainer housing comprises a molded plastic.

12. The propulsion system of claim 7, wherein the relief valve comprises:

a valve body;

an inlet formed within the valve body;

a plurality of outlets formed circumferentially around a center of the valve body; and a spring-loaded valve element disposed within the valve body and configured to control fluid flow from the inlet to the plurality of outlets.

13. The propulsion system of claim 7, wherein the propulsion system comprises one relief valve for the propulsion system, namely a single relief valve, and the single relief valve is configured to provide pressure relief for the propulsion system both upstream and downstream of the check valve.

14. A vehicle comprising:

a fuel tank;

a drive system; and a propulsion system coupled to the drive system, the propulsion system comprising:

an engine;

a retainer housing disposed within the fuel tank;

a fuel pump mounted on the retainer housing and configured to supply fuel flow having a pressure;

a check valve mounted on the retainer housing and configured to receive the fuel flow from the fuel pump and to allow passage of the fuel flow to the engine; and a single relief valve for the propulsion system, the single relief valve mounted on the retainer housing, coupled to the fuel pump, and configured to release a portion of the pressure of the fuel flow, the single relief valve disposed upstream of the check valve, the single relief valve configured to provide pressure relief for the propulsion system both upstream and downstream of the check valve.

15. The vehicle of claim 14, wherein the engine comprises a diesel fuel combustion engine.

16. The vehicle of claim 14, wherein the propulsion system further comprises:

a fuel filter coupled between the check valve and the engine and configured to filter the fuel flow between the check valve and the engine; and a reservoir having a first wall and disposed within the fuel tank;

wherein:

the retainer is surrounded by the first wall of the reservoir;

the fuel tank has a second wall that surrounds the first wall of the reservoir; and the fuel filter is disposed outside the fuel tank.

17. The vehicle of claim 14, wherein the single relief valve is connected between the fuel pump and the check valve and is not part of the fuel pump.

18. The vehicle of claim 14, wherein the propulsion system further comprises:

a strainer mounted on the retainer housing and coupled to the fuel pump.

19. The vehicle of claim 14, wherein the retainer housing comprises a molded plastic.

20. The vehicle of claim 14, wherein the single relief valve comprises:

a valve body;

an inlet formed within the valve body;

a plurality of outlets formed circumferentially around a center of the valve body; and a spring-loaded valve element disposed within the valve body and configured to control fluid flow from the inlet to the plurality of outlets.

* * * * *